US011098892B2

(12) United States Patent
Gerdes

(10) Patent No.: US 11,098,892 B2
(45) Date of Patent: Aug. 24, 2021

(54) DUAL VENTURI SINGLE CHAMBER GAS BURNER

(71) Applicants: BSH Home Appliances Corporation, Irvine, CA (US); BSH Hausgeräte GmbH, Munich (DE)

(72) Inventor: Michael Gerdes, Trent Woods, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 260 days.

(21) Appl. No.: 16/454,111

(22) Filed: Jun. 27, 2019

(65) Prior Publication Data

US 2020/0408402 A1 Dec. 31, 2020

(51) Int. Cl.

| | |
|---|---|
| ***F23D 14/06*** | (2006.01) |
| ***F23N 1/00*** | (2006.01) |
| ***F23D 14/64*** | (2006.01) |
| ***F24C 3/08*** | (2006.01) |

(52) U.S. Cl.

CPC ..... *F23D 14/06* (2013.01); *F23D 14/64* (2013.01); *F23N 1/005* (2013.01); *F24C 3/082* (2013.01)

(58) Field of Classification Search

CPC ..... F23D 14/06; F23D 14/64; F23D 2900/14063; F24C 3/085; F24C 3/126

See application file for complete search history.

(56) References Cited

U.S. PATENT DOCUMENTS

| | | | | |
|---|---|---|---|---|
| 4,092,975 | A * | 6/1978 | Grammatopoulos | A47J 37/0713 126/41 R |
| 5,052,920 | A * | 10/1991 | Warren | F23D 14/46 431/354 |
| 7,661,954 | B2 * | 2/2010 | Harneit | F23D 14/06 431/278 |
| 7,717,105 | B2 * | 5/2010 | Lee | F24C 3/047 126/39 J |
| 7,721,726 | B2 * | 5/2010 | Lee | F23D 14/14 126/39 H |
| 7,934,926 | B2 * | 5/2011 | Kornbluth | F23L 15/04 431/79 |
| 8,973,569 | B2 | 3/2015 | Padgett et al. | |
| 9,970,662 | B2 | 5/2018 | Cadima | |
| 10,948,196 | B2 * | 3/2021 | Mok | F23D 14/62 |

(Continued)

FOREIGN PATENT DOCUMENTS

WO 2013080116 A2 6/2013

*Primary Examiner* — David J Laux
*Assistant Examiner* — Nikhil P Mashruwala
(74) *Attorney, Agent, or Firm* — Michael E. Tschupp; Andre Pallapies; Brandon G. Braun

(57) ABSTRACT

A cooking appliance is provided, including a gas burner assembly for a cooktop floor of a cooking appliance. The gas burner assembly includes a burner body having a single combustion chamber and a plurality of flame ports in fluid communication with the single combustion chamber, a first mixing tube in fluid communication with the single combustion chamber and configured to supply a first air-gas mixture to the single combustion chamber, and a second mixing tube in fluid communication with the single combustion chamber and configured to supply a second air-gas mixture to the single combustion chamber.

15 Claims, 9 Drawing Sheets

(56) References Cited

U.S. PATENT DOCUMENTS

| | | | | |
|---|---|---|---|---|
| 2009/0047611 | A1* | 2/2009 | Armanni | F23D 14/065 431/284 |
| 2017/0038077 | A1 | 2/2017 | Gasparini et al. | |
| 2017/0276373 | A1 | 9/2017 | Cadima | |
| 2018/0135851 | A1 | 5/2018 | Biagioli et al. | |

* cited by examiner

DUAL VENTURI SINGLE CHAMBER GAS BURNER

FIELD OF THE INVENTION

The present invention is directed to a dual venturi single chamber gas burner, and a cooking appliance having a dual venturi single chamber gas burner.

BACKGROUND OF THE INVENTION

Conventional atmospheric gas surface cooking units, such as a gas range, stove, or cooktop, may include one or more gas burners for heating foodstuff in a cooking vessel, such as a pot, pan, kettle, etc. To provide more cooking options, some conventional cooking units include burners with a simmer function that can operate at low BTUs. Gas burners come in many configurations including, for example, simple single stage burners (as schematically illustrated in FIG. 9), dual stacked burners (i.e., having two stages, as schematically illustrated in FIG. 10), double or triple ring burners (i.e., two or three stage burners), etc. As schematically shown in FIG. 9, a conventional single stage burner typically may have a burner body 500 with a single combustion chamber 701 and may be supplied with an air-gas mixture by a single mixing tube (e.g., venturi) 502 and orifice 504 coupled to a gas supply line (not shown) by a gas valve (not shown). The single stage burner provides a single stage flame ring. As schematically shown in FIG. 10, a conventional dual stacked burner may have two stacked burner bodies 600, 602, each with a separate, dedicated combustion chamber 701, 703 and each being separately supplied with an air-gas mixture by a respective venturi 604 and orifice 606 coupled to a gas supply line (not shown) by a gas valve (not shown). The dual stacked burner typically provides two separate stages including a primary stage 610 and a secondary stage 620. Some other conventional multi-stage burners may have two or more concentric rings, such as a larger diameter outer ring and a smaller diameter inner ring. The conventional multi-stage burner may provide two stages including a primary stage for the outer ring and a secondary stage for the inner ring, with each ring being supplied with a separate air-gas mixture using a separate, dedicated venturi and gas orifice for each stage. Each of the conventional configurations typically can be provided as either a fully sealed "cup burner" or "top breather" burner, which relies on all air (e.g., primary and secondary air) for combustion being supplied/drawn from above the cooktop surface, or a "bottom breather" burner, which is designed to have the primary air supplied from below the cooktop surface and the secondary air for combustion being drawn from above the cooktop surface.

SUMMARY OF THE INVENTION

The present invention recognizes that, to provide more cooking options, some conventional burners may be configured to provide simmer functionality, for example, to heat the contents of a cooking utensil on low heat without boiling, such as to heat sauces, braise foodstuff, slow cook foodstuff, etc. For example, a burner unit (such as a single stage burner unit, as shown in the example in FIG. 9) may be configured to provide a simmer functionality when a gas valve supplying the burner is at a lowest setting (e.g., a lowest flow setting). For example, a valve control or actuator (e.g., control knob) of a gas burner can be configured to be rotated (e.g., rotated counterclockwise) from an OFF position to a 'HIGH' position, to a 'LOW' position, and finally to a SIMMER position. In the OFF position, the valve prevents any gas from flowing to the orifice of the burner unit (i.e., zero gas flow). In the 'HIGH' position, the valve enables a maximum amount of gas to flow to the orifice of the burner unit (i.e., maximum gas flow). In the 'LOW' position, the valve enables an intermediate amount of gas to flow to the orifice of the burner unit (i.e., a gas flow that is less than a maximum flow). In the SIMMER position, the valve enables the lowest or minimal amount of gas to flow to the orifice of the burner unit without shutting the valve off completely (i.e., a gas flow that is less than the low position and greater than zero flow). In other examples, a single stage burner unit may be configured to provide a simmer functionality by cycling a gas burner on/off in order to reduce a heat output of the burner. In still other examples, a simmer functionality may be provided by a multi-stage burner (as shown in the example in FIG. 10), in which two burner assemblies are stacked on top of each other to provide two flame rings capable of providing different BTUs. The larger diameter outer ring may be configured for a higher BTU operation and a smaller diameter inner ring may be configured for lower BTU operation, such as simmer functionality. In these examples, each of the stacked burner bodies typically has a separate, dedicated combustion chamber, with each combustion chamber being separately supplied with an air-gas mixture by a respective venturi and orifice coupled to a gas supply.

The present invention recognizes that each of the conventional gas burner configurations commonly are designed for the highest achievable turndown ratio from high fire to low fire (i.e., the ratio of the maximum heat output to the minimum heat output), given their specific form factors, which results in particular advantages and disadvantages. For example, while some single stage burner configurations may have an advantage of being simpler and/or less costly designs to produce, due to the limitations of the range of performance of a single venturi/jet configuration in these designs, such a single stage burner configuration typically must be optimized for the high fire operation, which results in compromises to design robustness and performance for low fire operation. The present invention recognizes that, as a result, during low fire operation, these conventional burner configurations may be susceptible to so-called flame out, for example, in instances in which other burners in the cooktop are operating on high fire or when other components of a cooking appliance, such as an oven fan, ventilation fan device, cooling air system, etc., are in operation, which instances may create a suction that disrupts or interferes with the venturi effect of the particular burner operating on low fire. In order to counter the effects on the low fire operation of the burner caused by the operation of other burners, components, etc., the simmer rate of the low fire operation of conventional burners typically must be raised to a higher BTU than would ordinarily be desired for simmer functionality in order for the low fire operation to remain stable. As a result, many conventional burners have difficulty providing, or are not capable of providing, desirable low or ultra-low simmer rates. Some conventional multi-stage burners have, to some extent, attempted to address these problems by separately optimizing each individual, separate stage of a multi-stage burner. However, these conventional multi-stage burners typically are more expensive to manufacture and may suffer from other performance deficiencies, such as larger spacing being required between the cooktop floor and cooking grates, an undesirably close proximity of the upper flame ring of a stacked burner to cooking vessels resulting in scorching, etc., susceptibility of the burner to capturing debris, spills, etc. and difficulty cleaning, for example with multi-stage burners have concentric rings, among other deficiencies.

To solve these and other problems, an exemplary embodiment of the present invention provides a dual venturi, single chamber gas burner for a cooktop floor of a cooking appliance comprising a burner body having a single combustion chamber and a plurality of flame ports in fluid communication with the single combustion chamber, a first mixing tube in fluid communication with the single combustion chamber and configured to supply a first air-gas mixture to the single combustion chamber, and a second mixing tube in fluid communication with the single combustion chamber and configured to supply a second air-gas mixture to the single combustion chamber (i.e., the same combustion chamber). The dual venturi, single chamber gas burner can include a first orifice injecting a first gas supply into the first mixing tube and a second orifice injecting a second gas supply into the second mixing tube. In some examples, a size of the first mixing tube can be different than a size of the second mixing tube and/or a size of the first orifice can be different than a size of the second orifice in order to optimize each of the plurality of supplies of the air-gas mixtures to the single combustion chamber. In this way, the exemplary embodiments of the invention can provide advantages of a simple, low cost burner assembly, while at the same time, improving the stability of the burner at low fire and reducing the simmer rate of the gas top burner to provide desirable low, or ultra-low, simmer functions.

According to the exemplary embodiments of the invention, a dual venturi, single chamber gas burner can be configured to be supplied by two gas supply lines via at least two different mixing tubes, such as venturis, including a primary gas supply line supplying a first venturi and a secondary gas supply line supplying a second venturi, similar to the concept of a double stack burner design. However, the present invention substantially differs both structurally and functionally from double stack burner designs by having only a single combustion chamber, instead of two, separate combustion chambers as used in a conventional double stack burner design. According to the invention, both of the venturis are arranged in fluid communication with the same combustion chamber, with a primary gas supply line supplying the first venturi (e.g., for high fire operation of the combustion chamber) and the secondary gas supply line supplying the second venturi (e.g., for low fire operation, or for both high fire and low fire operation of the combustion chamber). In this way, each venturi can be optimized (e.g., for a particular turndown ratio) to operate within a range that is most efficient for operation without backpressure issues and within a particular turndown range. One or more of the gas jet, gas orifice, and gas supply (e.g., volume, pressure, etc.) also can be optimized for a particular turndown ratio while minimizing or avoiding disruption or interfere with the venturi effect, particularly on low fire, owing to operation of other burners of the cooktop operating on high fire and/or other components of a cooking appliance, such as an oven with a fan, ventilation fan devices, cooling air systems, etc.

For example, the gas burner can be configured to provide a variable burner range of, for example, 100%-10% flow rate. With a single venturi, in order to provide a predetermined turndown flow ratio (e.g., 10 to 1), a much larger turndown in pressure will result (e.g., 100 to 1), which may leave these conventional burner configurations susceptible to so-called flame out during low fire operation. In the examples according to the invention, each venturi can be configured or optimized for a smaller range of turndown ratio, such as 5 to 1, instead of a larger range of 10 to 1 with a single venturi, thereby resulting in a lower turndown in pressure for each venturi. In this way, each venturi can be optimized to operate efficiently and with minimal or no backpressure issues within its respective turndown range, while providing the single chamber gas burner with the same overall turndown range.

In an example of the present invention, a two-stage gas valve can be used to supply both gas supply lines (i.e., primary gas supply line and secondary gas supply line) with full gas pressure at a 'HIGH' setting position. As a user rotates the control knob of the two-stage gas valve towards a 'LOW' setting position, the primary side of the two-stage gas valve can be configured for a particular turndown ratio to meter the gas pressure down while the pressure of the secondary side of the two-stage gas valve remains constant. When the control knob of the two-stage gas valve reaches the 'LOW' setting position, the primary side of the two-stage gas valve terminates the flow of the primary gas, while the secondary side of the two-stage gas valve remains at a constant full pressure. As the user continues to rotate the control knob from the 'LOW' setting position towards a 'SIMMER' setting position, the secondary side of the two-stage gas valve can be configured for a particular turndown ratio to meter the gas pressure down to a minimum gas pressure capable of being provided by the secondary side of the two-stage gas valve. In this example, the final simmer rate can be selected or determined, for example, by the minimum gas flow rate capable of being provided by the secondary side of the two-stage gas valve. In some examples, the final simmer rate can be controlled by a properly sized secondary orifice size. At a high fire position, the total gas flow delivered to the single stage burner is the sum of the gas delivered by both the primary and secondary orifices. At the low fire position, the total gas flow delivered to the single stage burner includes only the gas delivered by the secondary orifice from the secondary side of the two-stage gas valve since the primary side of the gas valve is turned off.

The dual venturi, single chamber gas burner, according to the examples, can be configured as a single or multi-stage burner, including a fully sealed "cup burner" or "top breather" burner, which relies on all air (e.g., primary and secondary air) for combustion being supplied/drawn from above the cooktop surface, or a "bottom breather" burner, which is designed to have the primary air supplied from below the cooktop surface and the secondary air for combustion being drawn from above the cooktop surface. A gas burner assembly also can be configured as a multi-stage burner or a stacked burner having a plurality of stacked burners with at least one of the burners being a dual venturi, single chamber gas burner having improved stability at 'LOW' fire and 'SIMMER' fire positions and reducing the simmer rate of the gas top burner to provide desirable low, or ultra-low, simmer functions.

The example features of the invention are important for providing a gas burner that will remain more stable at lower, low fire rates when subjected to pressure disturbances within and outside the cooking appliance. The exemplary dual venturi, single chamber gas burner can include a less costly single stage burner design, while at the same time being capable of achieving high gas turndown rates with more stable simmer rates. The exemplary dual venturi, single chamber gas burner may be immune to, or less susceptible to, disruption or interference with the venturi effect of the burner operating on low fire resulting from operation of other burners of the cooktop operating on high fire and/or other components of a cooking appliance, such as an oven with a fan, ventilation fan devices, cooling air systems, etc.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

With reference to FIGS. 1-8, exemplary embodiments of a cooking appliance 100 including a gas surface cooking unit 100 having a dual venturi, single chamber gas burner or burner assembly 200, will now be described.

Figure 1:
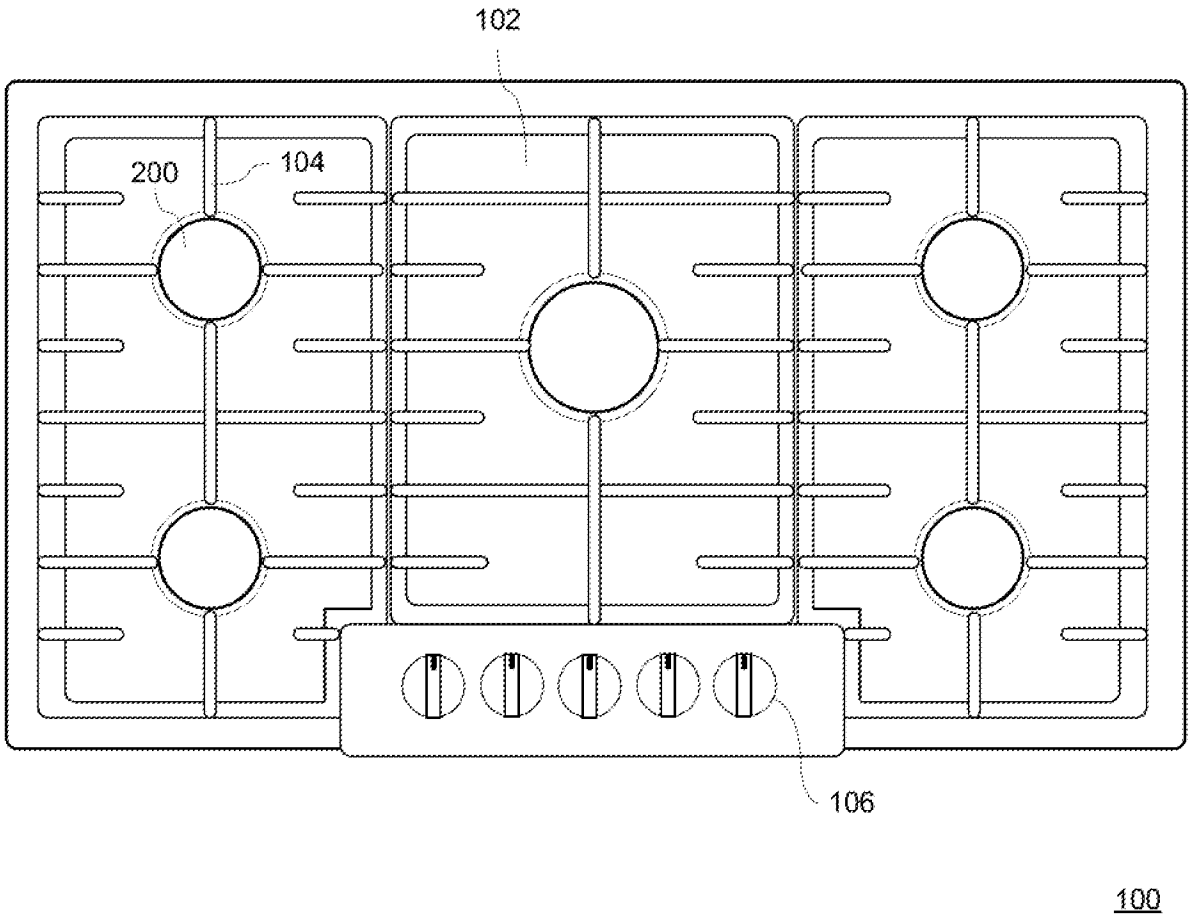
FIG. 1 is a top view of a cooking appliance having a gas burner assembly with a dual venturi, single chamber gas burner according to an exemplary embodiment of the invention.

FIG. 1 illustrates an example of a cooking appliance having a gas surface cooking unit 100 including one or more gas burners 200 for heating foodstuff in a cooking vessel, such as a pot, pan, kettle, etc. The gas surface cooking unit 100 can be, for example, a surface cooking unit of a freestanding or slide-in gas range (e.g., a gas cooktop, gas or electric oven combination, dual-fuel range, etc.), a gas cooktop or rangetop (e.g., counter mounted, island mounted, etc.), a gas hob, a gas stove, a gas grill, a standalone gas burner cooker (e.g., a countertop cooker), etc. The gas surface cooking unit 100 can include a cooktop floor 102 (e.g., a fixed or removable spill tray or top sheet, glass surface, etc.) for catching spills, overflows, etc. from a cooking vessel and/or for concealing other components of the cooking unit, such as gas supply lines, electrical wiring, etc. (not visible in FIG. 1). The gas surface cooking unit 100 includes one or more cooking vessel supports 104, such as a cooking grate, griddle, grill, teppanyaki grill, etc., for supporting one or more cooking vessels above one or more gas burners 200. The gas surface cooking unit 100 can include a control panel, such as one or more control knobs 106 or other user input devices, for controlling one or more gas burners 200, or other cooking components (e.g., oven, warming drawer, etc.) of the appliance. A cooktop floor 102 can extend under one or more of the gas burners 200. One of more gas supply lines can be disposed under the cooktop floor 102 and configured to supply gas to the gas burners 200. For example, a main gas line (e.g., 300 in FIGS. 2-6) can supply or convey gas to a gas manifold, which in turn supplies the gas to each respective burner 200, for example through one or more individual gas lines for each burner 200.

Figure 3:
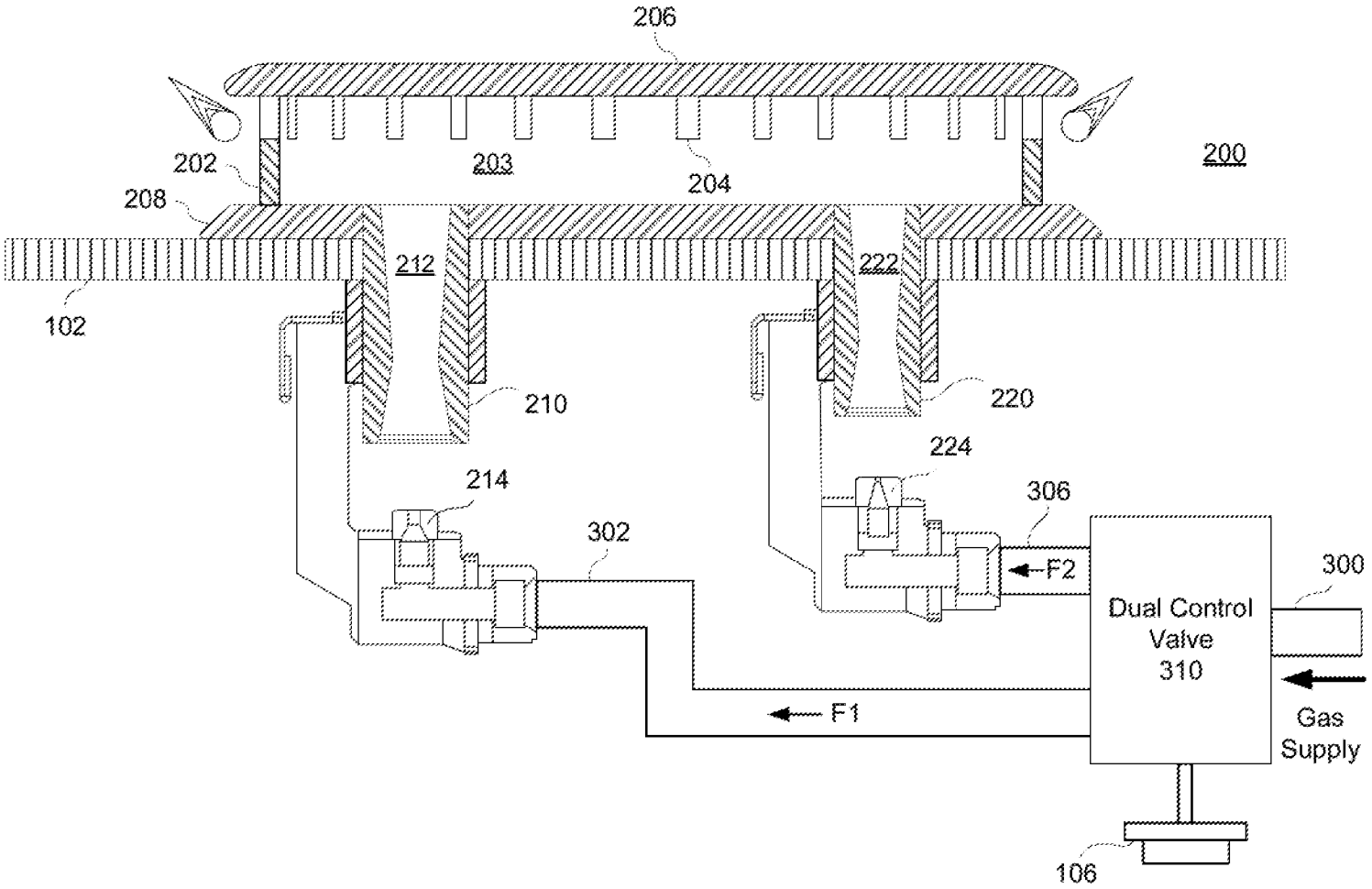
FIG. 3 is a schematic cross-sectional view of the gas burner assembly having a dual venturi, single chamber gas burner of FIG. 2.
Figure 4:
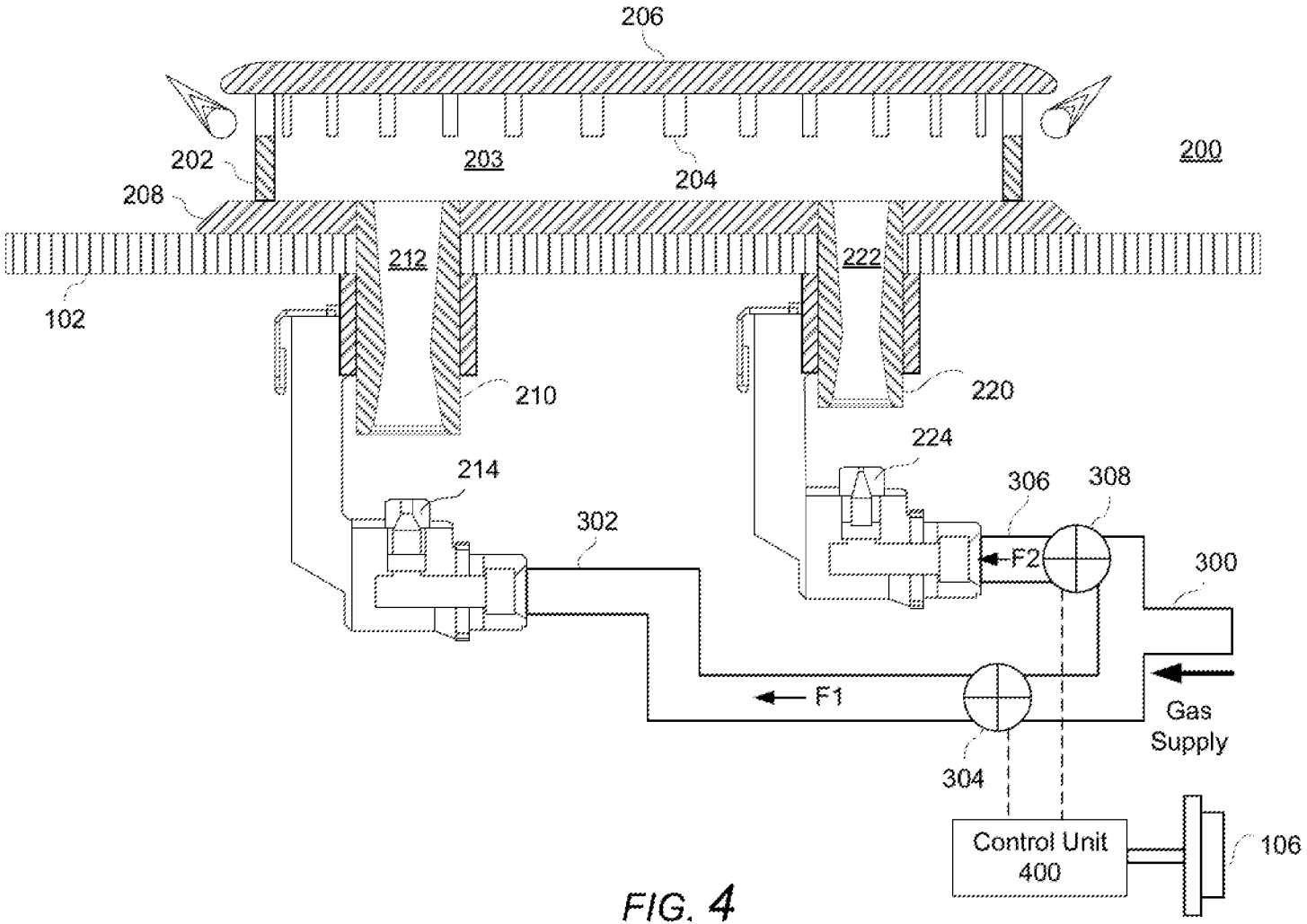
FIG. 4 is a schematic view of a gas burner assembly having a dual venturi, single chamber gas burner according to an exemplary embodiment of the invention.
Figure 5:
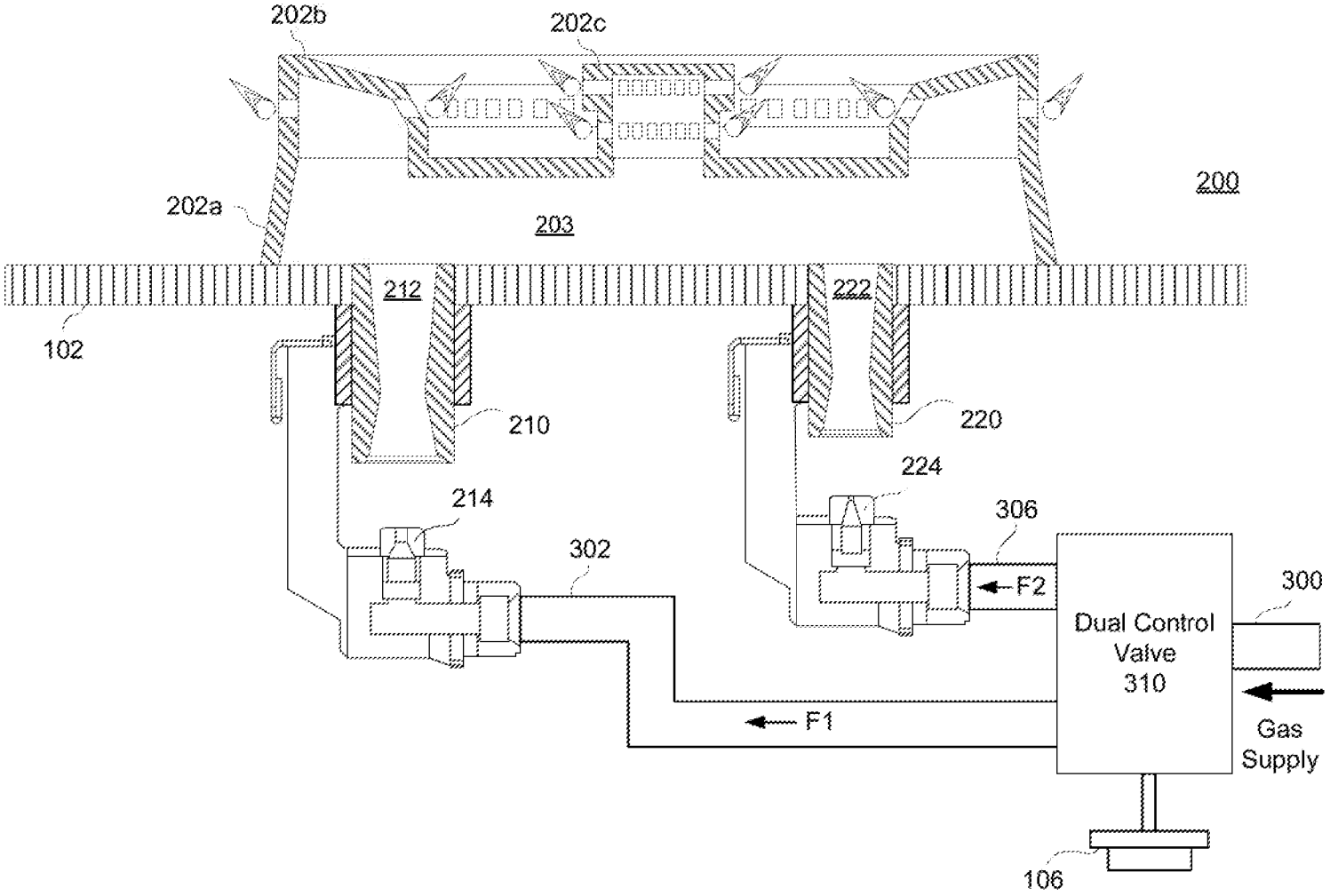
FIG. 5 is a schematic view of a gas burner assembly having a dual venturi, single chamber gas burner according to an exemplary embodiment of the invention.
Figure 6:
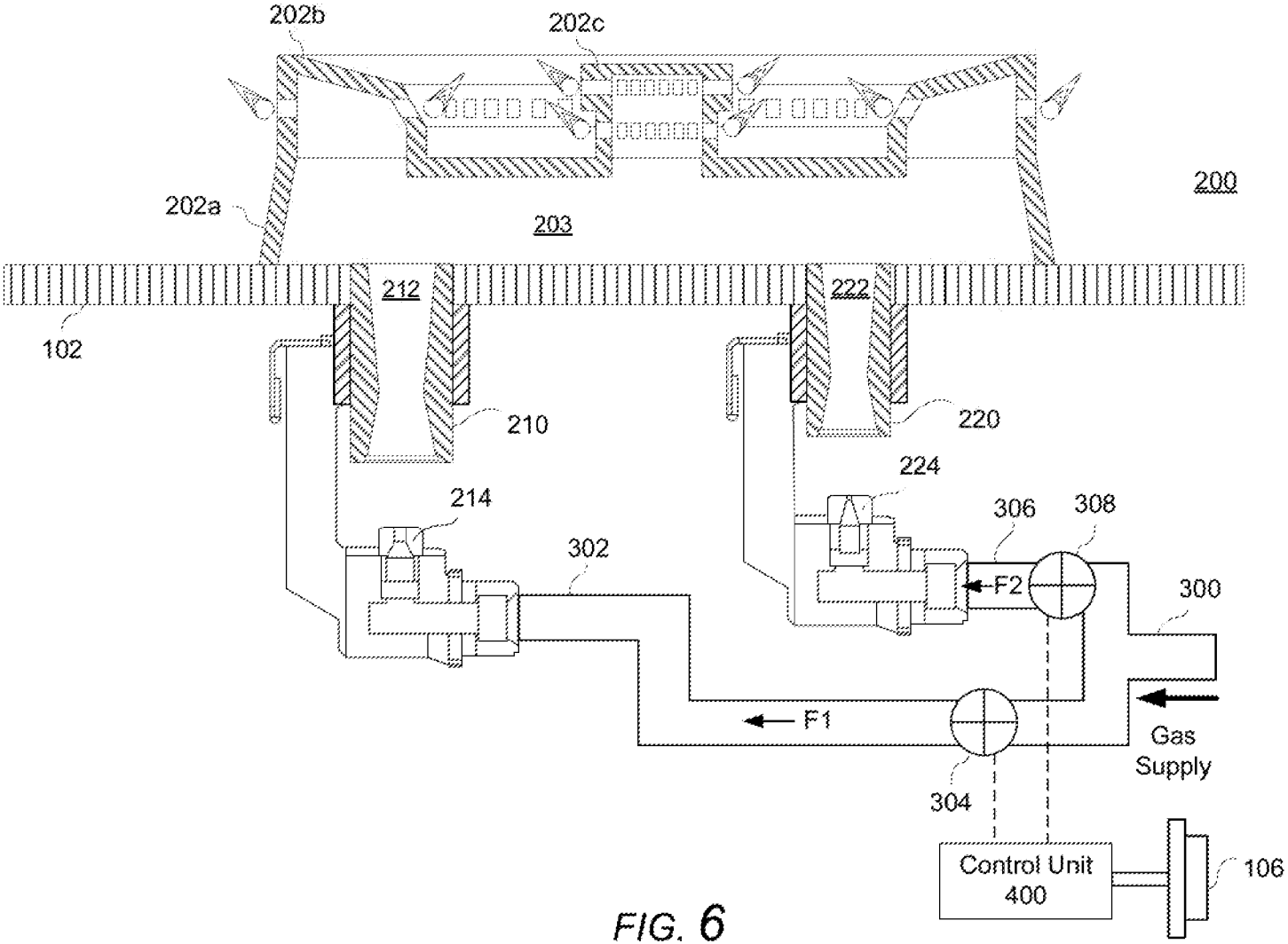
FIG. 6 is a schematic view of a gas burner assembly having a dual venturi, single chamber gas burner according to an exemplary embodiment of the invention.

As shown in FIGS. 2-6, examples of a gas burner assembly 200 for a cooktop floor 102 of a cooking appliance can include a burner body 202 having a single combustion chamber 203 and a plurality of flame ports 204 in fluid communication with the single combustion chamber 203. The single combustion chamber 203 can be formed or defined, for example, by a continuous perimeter wall or by a plurality of walls forming a plurality of sub-chamber portions in fluid communication with each other and the flame ports 204. In the examples shown in FIGS. 2-4, the burner assembly 200 includes a cap 206 covering the combustion chamber 203 and a base 208 supporting the combustion chamber 203 on the cooktop floor 102. Other arrangements are possible within the spirit and scope of the invention, such as an open burner arrangement, a cup burner arrangement, a wok burner arrangement, or another arrangement. For example, as shown in FIGS. 5 and 6, a burner assembly 200 can be configured as a wok burner arrangement including a burner head/base portion 202*a* having a single combustion chamber 203 and a burner ring portion 202*b* having a plurality of flame ports 204 disposed on the burner head/base portion 202*a* and in fluid communication with the single combustion chamber 203. In this example, the burner assembly 200 also can include a center burner head portion 202*c* having a plurality of flame ports in fluid communication with the combustion chamber 203.

With reference again to the examples in FIGS. 2-6, the gas burner assembly 200 can include a first mixing tube 210 in fluid communication with the single combustion chamber 203 and configured to supply a first air-gas mixture to the single combustion chamber 203 and a second mixing tube 220 in fluid communication with the same, single combustion chamber 203 and configured to supply a second air-gas mixture to the same, single combustion chamber 203. The first and second mixing tubes 210, 220 are schematically illustrated in FIGS. 2-6. Each of the first and second mixing tubes 210, 220 can include a tapered or constricted passageway 212, 222 configured to receive a supply of gas and reduce fluid pressure, thereby drawing atmospheric air (e.g., from below the cooktop floor 102) into the mixing tube and mixing the atmospheric air with the gas to supply an air-gas mixture to the single combustion chamber 203. In an example, the first and second mixing tubes 210, 220 can include first and second venturi tubes. The first and second mixing tubes 210, 220 can be separate components, or the first and second mixing tubes 210, 220 can be integrally formed with one or more tubes, connecting tubes, or other components. The first and second mixing tubes 210, 220 are not limited to the example arrangements and can be configured in various ways to supply a first air-gas mixture to the single combustion chamber 203 and a second air-gas mixture to the same, single combustion chamber 203.

As shown in the examples in FIGS. 2-6, a downstream end of each of the venturis 210, 220 is arranged in fluid communication with the same, single combustion chamber 203. Each of the venturis 210, 220 is configured to receive a gas injected, for example, into an upstream end of the venturi 210, 220 by a respective gas orifice or jet 214, 224. In these examples, atmospheric air is drawn in from a space below the cooktop floor 102 into the respective venturis 210, 220 and mixed with the injected gas from the respective orifice or jet 214, 224 to supply both air-gas mixtures to the same, single combustion chamber 203. In other examples, atmospheric air can be drawn into the venturis 210, 220 from a space above the cooktop floor 102, drawn through an opening in the cooktop floor 102, an opening in one or more parts of the burner assembly 200, drawn from a combination of spaces from above and below the cooktop floor 102, etc.

A primary gas supply line or connection 302 can be configured to supply a first gas flow F1 (i.e., first gas volumetric flow) to the first orifice or jet 214 to be injected into the first venturi 210 (e.g., for high fire operation of the combustion chamber 203) and the secondary gas supply line or connection 306 can be configured to supply a second gas flow F2 (i.e., second gas volumetric flow) to the second orifice or jet 224 to be injected into the second venturi 220 (e.g., for low fire operation, or for both high fire and low fire operation of the combustion chamber 203). The primary gas supply line/connection 302 and secondary gas supply line/connection 306 can include one or more gas supply lines, tubes, pipes, etc. configured to convey gas to each of the gas orifices or jets 214, 224 from one or more other components, such as one or more control valves (e.g., 304, 308, 310, etc.) coupled to the main gas supply 300, a gas manifold coupled to the main gas supply 300, etc. In other examples, the primary and secondary gas lines/connections 302, 306 can be provided by a direct connection or coupling between the gas orifices or jets 214, 224 and one or more other components, such as a direction connection or coupling with a respective control valve (e.g., an outlet of a respective control valve 304, 308, 310, etc.).

Figure 2:
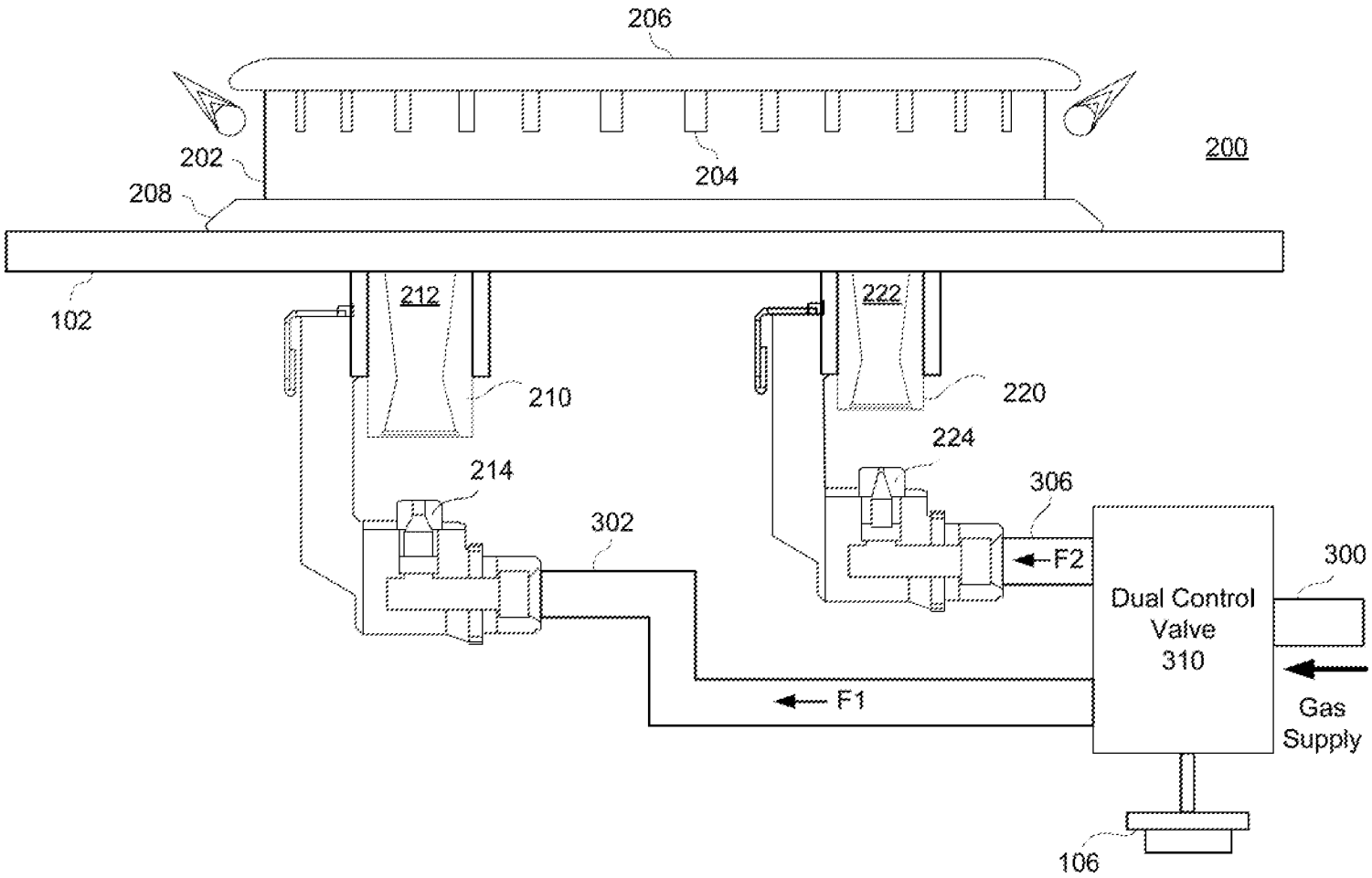
FIG. 2 is a schematic view of a gas burner assembly having a dual venturi, single chamber gas burner according to an exemplary embodiment of the invention.

The gas supply (i.e., gas volumetric flow F1, F2) from the main gas supply 300 to each of the gas orifices or jets 214, 224 can be separately controllable, for example, by a dual or two stage control valve 310, as shown for example in FIGS. 2, 3, and 5, by one or more individual control valves 304, 308, as shown for example in FIGS. 4 and 6, by a valve assembly, etc. As shown in the examples in FIGS. 2-6, the control valves (e.g., 304, 308, 310) can be configured to be controlled by a user actuating an actuation element (e.g., a control knob 106). As shown in the examples illustrated in FIGS. 2, 3, and 5, a gas cooking appliance can include a multi-stage control valve having an inlet for receiving a gas supply from a main gas line 300 or a gas manifold of the gas cooking appliance and a plurality of outlets for conveying a plurality of gas flows. In this example, the gas cooking appliance includes a dual or two stage control valve 310 having an inlet for receiving a gas supply from a main gas line 300 and two gas outlets. A first outlet is coupled to the primary gas line/connection 302 and supplies the first gas volumetric flow F1 to the gas orifice or jet 214. A second outlet is coupled to the secondary gas line/connection 306 and supplies the second gas volumetric flow F2 to the gas orifice or jet 224. The dual or two stage control valve 310 can be actuated by a user using the control knob 106.

In other examples, as shown in the example in FIGS. 4 and 6, a gas cooking appliance according to the invention can include a plurality of control valves for receiving a gas supply from a main gas line 300 or a gas manifold of the gas cooking appliance. In these examples, the gas cooking appliance can include a first control valve 304 and a second control valve 308, each having an inlet configured to receive a gas supply from a main gas line 300. The first control valve 304 has an outlet coupled to the primary gas line/connection 302 that supplies the first gas volumetric flow F1 to the gas orifice or jet 214. The second control valve 308 has an outlet coupled to the secondary gas line/connection 306 that supplies the second gas volumetric flow F2 to the gas orifice or jet 224. In this example, the gas cooking appliance can include a control unit 400 configured to control operation of the control valves 304, 308, for example, by controlling one or more solenoids (e.g., the control valves 304, 308 can include one or more switchable solenoid valves) in response to a user actuating the control knob 106.

In some examples, a size of the first mixing tube 210 (e.g., first venturi) can be different from a size of the second mixing tube 220 (e.g., second venturi). For example, the size of the tapered or constricted passageways 212, 222 of the venturis 210, 220 can be different in order to optimize operation of the respective mixing tube 210, 220 within a range that is most efficient within a particular turndown ratio of the burner (e.g., maximum to minimum heat output of the burner) while minimizing or avoiding problems with backpressure caused by other internal or external components of the appliance. The first venturi 210 can be used for a primary gas supply to the combustion chamber 203 for high fire operation and the second venturi 220 can be used for a secondary gas supply to the combustion chamber 203 for low fire operation, or for both high fire and low fire operation of the combustion chamber. Each venturi 210, 220 can be configured and/or optimized for a smaller turndown ratio of the burner, such as a 5 to 1 turndown ration, thereby resulting in a lower turndown in pressure for each venturi 210, 220.

In other examples, a size of the first gas jet or orifice 214 can be different from a size of the second gas jet or orifice 224, for example, to optimize operation of the respective mixing tube 210, 220 within a range that is most efficient within a particular turndown range while minimizing or avoiding problems with backpressure caused by other internal or external components of the appliance. The first gas jet or orifice 214 can be used for a primary gas supply to the combustion chamber 203 for high fire operation and the second gas jet or orifice 224 can be used for a secondary gas supply to the combustion chamber 203 for low fire operation or for both high fire and low fire operation of the combustion chamber 203.

With reference again to the examples in FIGS. 2-6, in some examples, one or more of the control valves (e.g., 304, 308, 310) can be configured or selected to optimize the maximum and/or minimum gas volumetric flow from one or more of the outlets of the valves to thereby optimize operation of one or more of the respective mixing tubes 210, 220 within a range that is most efficient within a particular turndown range while minimizing or avoiding problems with backpressure caused by other internal or external components of the appliance. For example, the total gas flow delivered to the single combustion chamber 203 is the sum of the primary and secondary gases F1, F2 delivered from the outlets of the control valves (e.g., 304, 308, 310). The minimum gas flow delivered to the single combustion chamber 203 can be configured or limited by the minimum gas flow rate of the secondary gas F2 capable of being provided by, for example, the outlet of the secondary side of the two-stage gas valve 310, in the examples shown in FIGS. 2, 3, and 5, or the outlet of the control valve 308.

An example operation of a gas burner assembly according to one of the exemplary embodiments of the invention shown, for example, in FIGS. 2-6, will now be described with reference to FIGS. 7 and 8.

A gas surface cooking unit 100 (as shown for example in FIG. 1) can include a control panel having one or more control knobs 106 for controlling one or more gas burners 200. In the example shown in FIG. 7, the control knob 106 is configured to be rotated from an 'OFF' position to a full/high 'ON' position, to a 'LOW' position, or to a 'SIMMER' position (e.g., ultra-low simmer position). In other examples, the control knob 106 can be configured to include additional, intermediate, and/or alternate control settings, and/or different arrangements of control settings, such as a 'MEDIUM' position, 'BOIL' position, 'IGNITE' position, 'HIGH' and 'LOW' positions, one or more numbered positions such as 0-4, 0-10, etc., one or more symbols, one or more lines having varying gradation, etc. The control knob 106 can be configured to rotate from the 'OFF' position in the clockwise direction, counter clockwise direction, or in both directions, and the setting positions can be arranged to increase or decrease accordingly. In some examples, the control knob 106 can directly actuate a control valve (e.g., 310 in FIGS. 2, 3, and 5) or a control unit 400 can be provided to control operation of one or more control valves (e.g., 304, 308 in FIGS. 4 and 6). In other examples, one or more other user input devices or control devices can be configured to control the one or more gas burners 200, such as a touch sensitive control device, touch screen or smart screen device, slide control device, etc. In still other examples, the control panel of the gas surface cooking unit 100 can be configured to be controlled remotely, for example, using a wireless configuration, a smart phone app, etc.

Figure 7:
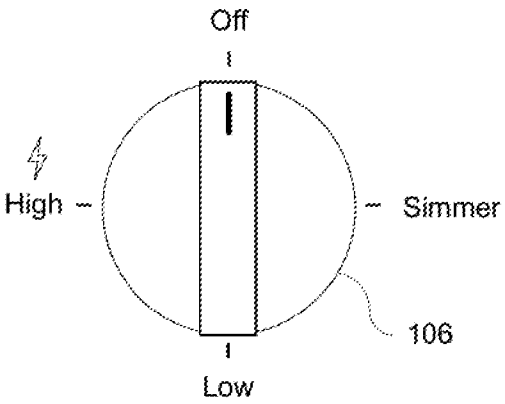
FIG. 7 is a schematic view of a control knob of a gas burner assembly having a dual venturi, single chamber gas burner according to an exemplary embodiment of the invention.
Figure 8:
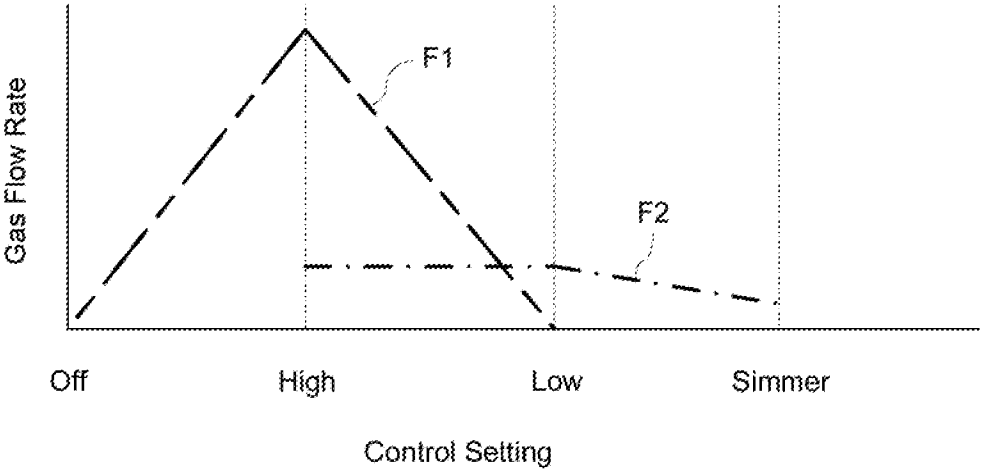
FIG. 8 is a graph showing a gas flow supplied to a gas burner assembly having a dual venturi, single chamber gas burner according to an exemplary embodiment of the invention.
Figure 9:
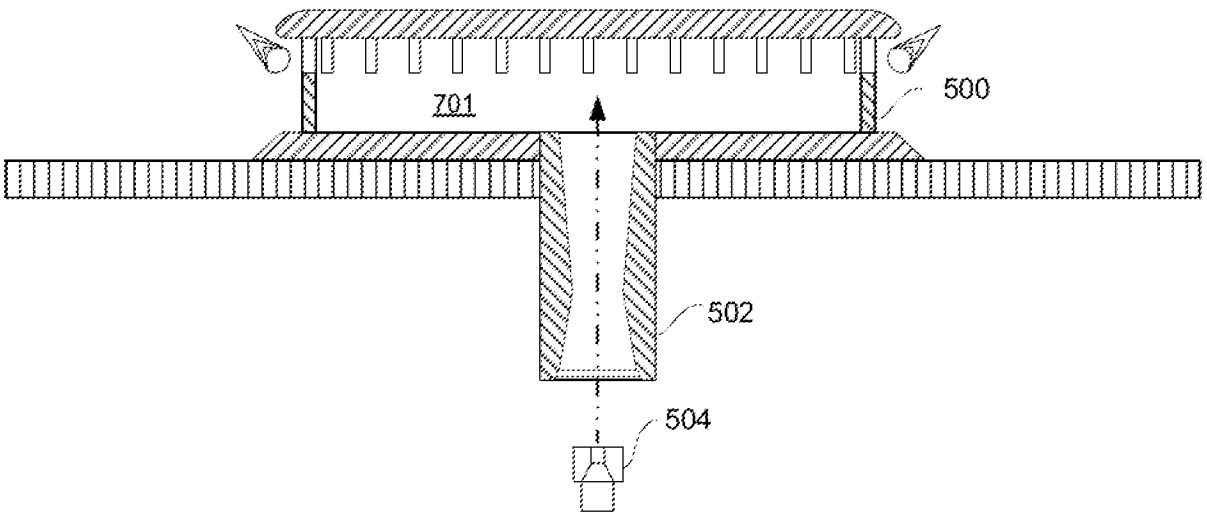
FIG. 9 (CONVENTIONAL ART)
FIG. 9 is a schematic view of a conventional single stage burner.
Figure 10:
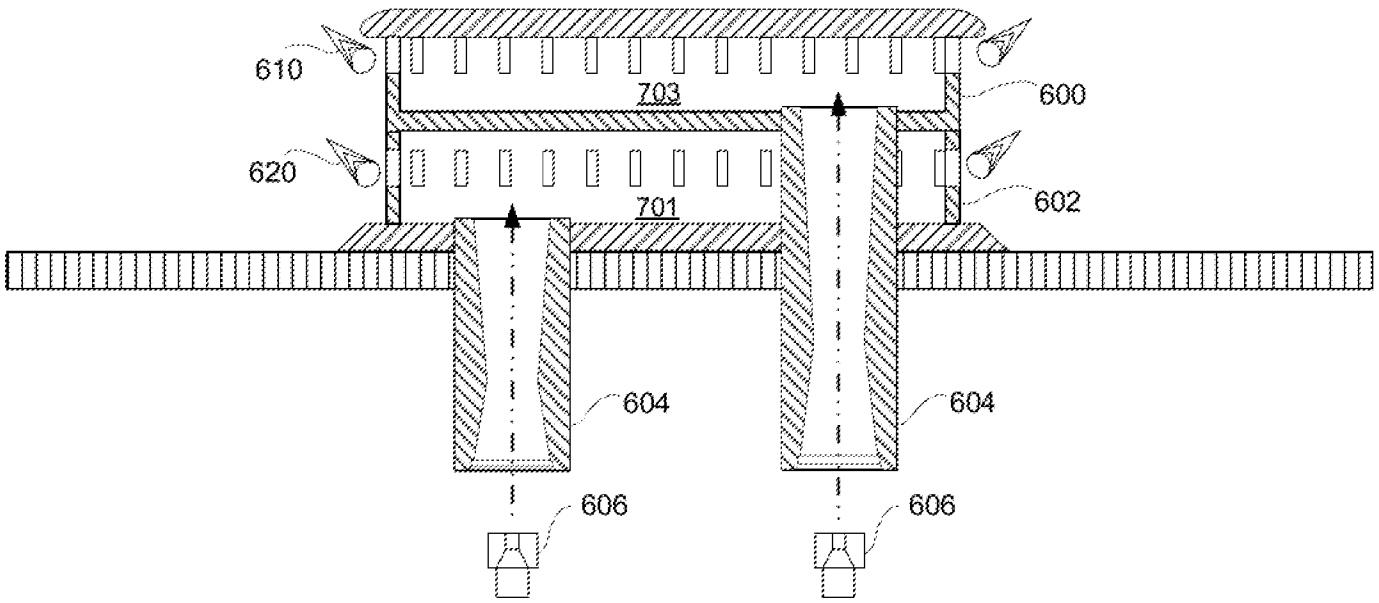
FIG. 10 (CONVENTIONAL ART)
FIG. 10 is a schematic view of a conventional dual stacked burner.

With reference to the example embodiments shown in FIGS. 2, 3, and 5 and the example operation illustrated in FIGS. 7 and 8, in the 'OFF' position, the two-stage gas valve 310 prevents any gas from flowing to the orifices 214, 224 of the burner unit (i.e., zero gas flow). When a user rotates the control knob 106 in the counterclockwise direction from an 'OFF' position to a 'FULL/HIGH ON' position, the two-stage gas valve 310 can be configured to supply both gas supply lines/connections (i.e., primary gas supply line/connection 302 and secondary gas supply lines/connection 306) to the first gas jet or orifice 214 and second gas jet or orifice 224 with a full gas pressure at a 'HIGH' fire setting position. As shown in FIG. 8, in this case, a maximum gas volumetric flow rate of the primary gas (i.e., max flow rate F1) and the secondary gas (i.e., max flow rate F2) simultaneously will be supplied from the outlets of the two-stage gas valve 310 to both the primary gas supply line/connection 302 and the secondary gas supply lines/connection 306 and then injected from the first gas jet or orifice 214 into the first venturi 210 and from the second gas jet or orifice 224 into the second venturi 220.

The flow of the primary and secondary gas F1, F2 through the first and second venturis 210, 220, respectively, draws air (in these examples, primary air drawn from below the cooktop floor 102) into the first and second venturis 210, 220, respectively, and mixes the air with the primary and secondary gas F1, F2 such that a first air-gas mixture and a secondary air-gas mixture are injected into to the same, single combustion chamber 203. The primary and secondary air-gas mixtures will flow through the single combustion chamber 203 and exit the ports 204 of the burner body 202, where the exiting air-gas mixture can be ignited by one or more igniters (not shown) to provide a flame ring (e.g., a single, annular flame ring around the burner body 202).

As the user rotates the control knob 106 from the 'HIGH' position towards a 'LOW' position, the primary side of the two-stage gas valve 310 can be configured to gradually or intermittently meter down the gas flow rate of the primary gas F1 being supplied from the first outlet of the two-stage gas valve 310 to the first gas jet or orifice 214 and into the first venturi 210, while the gas flow rate of the secondary gas F2 from the second outlet of the two-stage gas valve 310 remains constant through this range such that the gas flow rate of the secondary gas F2 being supplied from the second outlet of the two-stage gas valve 310 to the second gas jet or orifice 224 and into the second venturi 220 remains at a constant full pressure.

When the control knob 106 of the two-stage gas valve 310 reaches the 'LOW' position, the primary side of the two-stage gas valve 310 terminates the flow of the primary gas F1 flowing from the first outlet to the first gas jet or orifice 214 into the first venturi 210, while the gas flow rate of the secondary gas F2 of the two-stage gas valve 310 remains constant such that the gas pressure of the secondary gas F2 flowing from the second outlet and being injected from the second gas jet or orifice 224 into the second venturi 220 remains at the constant full pressure.

As a user continues to rotate the control knob 106 from the 'LOW' position towards a 'SIMMER' position, the secondary side of the two-stage gas valve 310 can be configured to gradually or intermittently meter down the gas flow rate of the secondary gas F2 being supplied to the second gas jet or orifice 224 and injected into the second venturi 220 until the gas flow rate of the secondary gas F2 reaches a minimum gas flow rate capable of being provided by the secondary side of the two-stage gas valve 310. In this example, the final simmer rate can be selected or determined, for example, by the minimum gas flow rate capable of being provided by the secondary side of the two-stage gas valve 310, by the size of the second orifice 224, and/or by a size of the venturi 222.

According to these examples, at a 'HIGH' fire position, the total gas flow delivered to the single combustion chamber 203 is the sum of the primary and secondary gases F1, F2 delivered by both the primary and secondary orifices 214, 224 to the venturis 210, 220. At the 'LOW' fire position, the total gas flow delivered to the single combustion chamber 203 includes only the secondary gas F2 delivered by the secondary orifice 214 to the second venturi 220, since the primary side of the gas valve 310 is turned off. At the 'SIMMER' fire position, the total gas flow delivered to the single combustion chamber 203 includes only the minimum gas flow rate of the secondary gas F2 capable of being provided by the secondary side of the two-stage gas valve 310, in the examples shown in FIGS. 2, 3, and 5. In this way, the exemplary embodiments of the invention can provide advantages of a simple, low cost, single stage burner assembly, while at the same time, improving the stability of the burner at 'LOW' fire and 'SIMMER' fire positions and reducing the simmer rate of the gas top burner to provide desirable low, or ultra-low, simmer functions.

The example embodiments shown in FIGS. 4 and 6 can be configured to operate in a similar way. For example, in the 'OFF' position, both control valves 304 and 308 prevent any gas from flowing to the orifices 214, 224 of the burner unit (i.e., zero gas flow). When a user rotates the control knob 106 in the counterclockwise direction from an 'OFF' position to a 'FULL/HIGH ON' position, the control unit 400 can be configured to actuate the control valves 304, 308 (e.g., actuate one or more solenoids of the control valves 304, 308) to supply both gas supply lines/connections (i.e., primary gas supply line/connection 302 and secondary gas supply lines/connection 306) and the first gas jet or orifice 214 and second gas jet or orifice 224 with a full gas pressure at a 'HIGH' fire setting position. As shown in FIG. 8, in this case, a maximum gas volumetric flow rate of the primary gas (i.e., max flow rate F1) and the secondary gas (i.e., max flow rate F2) simultaneously will be supplied from the outlets of the control valves 304, 308 to both the primary gas supply line/connection 302 and the secondary gas supply lines/connection 306 and then injected from the first gas jet or orifice 214 into the first venturi 210 and from the second gas jet or orifice 224 into the second venturi 220.

As the user rotates the control knob 106 from the 'HIGH' position towards a 'LOW' position, the control unit 400 can be configured to gradually or intermittently meter down the gas flow rate of the primary gas F1 being supplied from the control valve 304 to the first gas jet or orifice 214 and into the first venturi 210, while the gas flow rate of the secondary gas F2 from the control valve 308 remains constant through this range such that the gas flow rate of the secondary gas F2 being supplied from the control valve 308 to the second gas jet or orifice 224 and into the second venturi 220 remains at a constant full pressure.

When the control knob 106 of the two-stage gas valve 310 reaches the 'LOW' position, the control unit 400 terminates the flow of the primary gas F1 flowing from the control valve 304 to the first gas jet or orifice 214 into the first venturi 210, while the gas flow rate of the secondary gas F2 from the control valve 308 remains constant such that the gas pressure of the secondary gas F2 flowing from the control valve 308 and being injected from the second gas jet or orifice 224 into the second venturi 220 remains at the constant full pressure.

As a user continues to rotate the control knob 106 from the 'LOW' position towards a 'SIMMER' position, the control unit 400 can be configured to gradually or intermittently meter down the gas flow rate of the secondary gas F2 being supplied from the control valve 308 to the second gas jet or orifice 224 and injected into the second venturi 220 until the gas flow rate of the secondary gas F2 reaches a minimum gas flow rate capable of being provided by the control valve 308. In this example, the final simmer rate can be selected or determined, for example, by the minimum gas flow rate capable of being provided by the control valve 308, by the size of the second orifice 224, and/or by a size of the venturi 222.

According to the examples in FIGS. 4 and 6, at a 'HIGH' fire position, the total gas flow delivered to the single combustion chamber 203 is the sum of the primary and secondary gases F1, F2 delivered by both the primary and secondary orifices 214, 224 to the venturis 210, 220. At the 'LOW' fire position, the total gas flow delivered to the single combustion chamber 203 includes only the secondary gas F2 delivered by the secondary orifice 214 to the second venturi 220, since the control valve 304 is turned off. At the 'SIMMER' fire position, the total gas flow delivered to the single combustion chamber 203 includes only the minimum gas flow rate of the secondary gas F2 capable of being provided by the individual control valve 308, as shown in FIGS. 4 and 6. In this way, the exemplary embodiments of the invention can provide advantages of a simple, low cost, single stage burner assembly, while at the same time, improving the stability of the burner at 'LOW' fire and 'SIMMER' fire positions and reducing the simmer rate of the gas top burner to provide desirable low, or ultra-low, simmer functions.

Other arrangements and operation of a gas burner assembly are possible within the spirit and scope of the invention. For example, the dual venturi, single chamber gas burner can be configured as a fully sealed "cup burner" or "top breather" burner, which relies on all air (e.g., primary and secondary air) for combustion being supplied/drawn from above the cooktop surface, or a "bottom breather" burner, which is designed to have the primary air supplied from below the cooktop surface and the secondary air for combustion being drawn from above the cooktop surface. A gas burner assembly also can be configured as a multi-stage burner or a stacked burner having a plurality of stacked burners with at least one of the burners being a dual venturi, single chamber gas burner having improved stability at 'LOW' fire and 'SIMMER' fire positions and reducing the simmer rate of the gas top burner to provide desirable low, or ultra-low, simmer functions.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A gas burner assembly for a cooktop floor of a cooking appliance, the gas burner assembly comprising:

a burner body having a single combustion chamber and a plurality of flame ports in fluid communication with the single combustion chamber;

a first mixing tube in fluid communication with the single combustion chamber and configured to convey a first air-gas mixture to the single combustion chamber; and a second mixing tube in fluid communication with the single combustion chamber and configured to convey a second air-gas mixture to the single combustion chamber, wherein the first mixing tube is a first venturi and the second mixing tube is a second venturi, a size of a first constriction of the first venturi is different than a size of a second constriction of the second venturi, the first mixing tube is configured for a first turndown ratio and the second mixing tube is configured for a second turndown ratio, and the first turndown ratio of the first mixing tube is different than the second turndown ratio of the second mixing tube.

2. The gas burner assembly of claim 1, wherein a size of the first mixing tube is different than a size of the second mixing tube.

3. The gas burner assembly of claim 1, further comprising:

a first orifice injecting a first gas supply into the first mixing tube for mixing with atmospheric air to provide the first air-gas mixture that is supplied to the single combustion chamber; and a second orifice injecting a second gas supply into the second mixing tube for mixing with atmospheric air to provide the second air-gas mixture that is supplied to the single combustion chamber.

4. The gas burner assembly of claim 3, wherein a size of the first orifice is different than a size of the second orifice.

5. The gas burner assembly of claim 3, wherein a size of one of the first orifice and the second orifice determines a minimum simmer flow rate of the gas burner.

6. The gas burner assembly of claim 1, further comprising:

at least one control valve controlling a flow of a first gas supply to the first mixing tube and a flow of a second gas supply to the second mixing tube.

7. The gas burner assembly of claim 6, wherein the at least one control valve is configured to provide a maximum flow rate to the single combustion chamber by simultaneously providing a maximum flow rate of the first gas supply to the first mixing tube and a maximum flow rate of the second gas supply to the second mixing tube.

8. The gas burner assembly of claim 6, wherein the at least one control valve is configured to provide a minimum simmer flow rate to the single combustion chamber by terminating a flow rate of the first gas supply to the first mixing tube while providing a minimum flow rate of the second gas supply to the second mixing tube.

9. The gas burner assembly of claim 6, wherein the at least one control valve is a two-stage control valve comprising:

an inlet configured to receive a main gas supply from a gas line;

a first outlet configured to supply the flow of the first gas supply to the first mixing tube; and a second outlet configured to supply the flow of the second gas supply to the second mixing tube.

10. The gas burner assembly of claim 1, further comprising:

a first control valve configured to separately control a flow of a first gas supply to the first mixing tube; and a second control valve configured to separately control a flow of a second gas supply to the second mixing tube.

11. The gas burner assembly of claim 10, further comprising:

a control unit configured to separately control the first control valve and the second control valve.

12. The gas burner assembly of claim 11, wherein the control unit is configured to control the first control valve and the second control valve to provide a maximum flow rate to the single combustion chamber by simultaneously providing a maximum flow rate of the first gas supply from the first control valve to the first mixing tube and a maximum flow rate of the second gas supply from the second control valve to the second mixing tube.

13. The gas burner assembly of claim 11, wherein the control unit is configured to provide a simmer setting by controlling the first control valve to terminate a flow rate of the first gas supply from the first control valve to the first mixing tube and controlling the second control valve to provide a minimum flow rate of the second gas supply capable of being provided by the second control valve to the second mixing tube.

14. A cooking appliance comprising:

a cooktop floor; and the gas burner assembly of claim 1, wherein the burner body is disposed on the cooktop floor.

15. The cooking appliance of claim 14, wherein an entry opening of each of the first mixing tube and the second mixing tube is disposed below the cooktop floor and each of the first mixing tube and the second mixing tube are configured to draw atmospheric air therein from a space below the cooktop floor.

* * * * *